US005998918A

United States Patent [19]

Do et al.

[11] Patent Number: 5,998,918

[45] Date of Patent: Dec. 7, 1999

[54] PHOSPHOR SCREEN FOR A FLICKERLESS CATHODE RAY TUBE AND A PROCESS FOR PREPARING THE SAME

[75] Inventors: Young-rag Do; Chang-won Park, both of Kyungki-do; Joon-bae Lee, Seoul; Won-ho Yoon, Kyungki-do, all of Rep. of Korea

[73] Assignee: Samsung Display Devices Co., Ltd., Rep. of Korea

[21] Appl. No.: 08/976,946

[22] Filed: Nov. 24, 1997

[30] Foreign Application Priority Data

Dec. 13, 1996 [KR] Rep. of Korea ..... 96-65360

[51] Int. Cl.[6] ..... H01J 29/20

[52] U.S. Cl. ..... 313/473; 313/461; 313/463; 313/467; 427/68

[58] Field of Search ..... 313/461, 463, 313/467, 473; 427/68

[56] References Cited

U.S. PATENT DOCUMENTS

| | | | |
|---|---|---|---|
| 3,826,944 | 7/1974 | Cooper | 313/461 |
| 5,569,977 | 10/1996 | Donofrio | 313/466 |
| 5,667,724 | 9/1997 | Petersen | 252/301.6 R |
| 5,866,977 | 2/1999 | Lee et al. | 313/463 |

*Primary Examiner*—Ashok Patel
*Attorney, Agent, or Firm*—Christie, Parker & Hale, LLP

[57] ABSTRACT

A method of manufacturing a phosphor screen for a flickerless cathode ray tube comprising the steps of forming red and green phosphor layers on a panel for a cathode ray tube on which a black matrix is formed, forming a blue phosphor layer on said panel on which a black matrix is formed by coating the blue phosphor slurry and drying and forming a double phosphor layer by coating an ultraviolet phosphor slurry on said blue phosphor layer and drying, is provided.

10 Claims, 1 Drawing Sheet

PHOSPHOR SCREEN FOR A FLICKERLESS CATHODE RAY TUBE AND A PROCESS FOR PREPARING THE SAME

CROSS-REFERENCE TO RELATED APPLICATION

This application claims priority of Korean Patent Application No. 96-65360, filed Dec. 13, 1996.

FIELD OF THE INVENTION

The present invention relates to phosphor screen for a cathode ray tube ("CRT") and, more particularly, to a phosphor screen for a flickerless CRT in which the flickering phenomena is reduced by forming a double phosphor screen with ultraviolet ("UV") phosphor on the conventional blue phosphor screen layer, and a process for preparing the same.

BACKGROUND OF THE INVENTION

A conventional shadow-mask CRT uses three electron beams deflected by a deflection coil. The beams traverse a perforated metal mask (shadow-mask) before impinging on a selected phosphor screen material. The selected phosphor formed on the inner surface of the screen comprises of a pattern of red, green and blue phosphors and a black matrix ("BM") which is formed between the phosphors. The three electron beams which pass through the shadow-mask converge on the screen and each beam impinges on one of the red, green and blue phosphors.

Generally, a process for forming a phosphor screen comprises first coating a photoresist on the inner surface of a panel. The photoresist is dried by heat or other means and exposed to UV rays irradiated through mask slots. The exposed panel is washed and developed to remove the unexposed photoresist and then dried.

A black matrix material is coated on the panel on which the photoresist-coated portion is regularly patterned. Thereafter, the panel is etched to produce the BM layer. Red, green and blue phosphors are sequentially coated on portions on which BM dots do not exist to produce a phosphor screen. As shown in FIG. 1, red, green, and blue phosphors individually exist in a conventional CRT. Various chemical elements having various decay time characteristics are conventionally used as red, green and blue phosphors. In particular, ZnS:Ag,CI and ZnS:Ag,AI phosphors are used as blue phosphor, and it takes 100–200 $\mu$s for the blue phosphor to be decayed to have 10% luminescence compared to its full luminescence (10% decay time). Generally, in a CRT, the scanning speed of an electron beam scanning line to scan the blue phosphor is about 16 ms. As shown above, the decay time for a conventional blue phosphor is very short compared to the scanning speed of an electron beam scanning line in a conventional CRT, and as a result a flickering phenomena occurs. Due to the flickering phenomenon, a person who watches TV or a monitor may feel eye fatigue.

SUMMARY OF THE INVENTION

In order to solve the problems described above, an object of the invention is to provide a phosphor screen for a flickerless CRT in which the flicker is reduced and a process for preparing the same by a simple manufacturing process compared to that of a conventional CRT.

In order to achieve this object, the present invention provides a phosphor screen for a flickerless CRT comprising a panel on which a black matrix is formed; a phosphor layer of red, green and blue formed on the regions of the panel on which the black matrix is not formed; and a UV phosphor layer formed on the blue phosphor layer.

Furthermore, the present invention provides a method of manufacturing a phosphor screen for a flickerless CRT comprising the steps of forming red and green phosphor layers on a panel for a CRT on which a black matrix is formed; forming a blue phosphor layer on the panel on which the black matrix is formed by coating the blue phosphor slurry and drying; and forming a double phosphor layer by coating a UV phosphor slurry on the blue phosphor layer and drying.

Preferably the wavelength of ultraviolet light emitted from the UV phosphor is in the range of 300–420 nm. Preferably the UV phosphor is selected from the group consisting of CaS:Pb, CaO:Pb, $Y_2O_3$:Gd, $HfO_2$:Ti, $Zn_2SiO_4$:Ti, $ZnGa_2O_4$:Li,Ti, $Y_2SiO_5$:Ce, $Y_2SI_2O_7$:Ce, $BaSi_2O_5$:Pb and $Ba_2SiO_4$:Pb. The preferred blue phosphor is ZnS:Ag,CI and ZnS:Ag,AI. The blue phosphors produce photoluminescence having a longer decay time than emission time by a electron beam. For example, because the decay time of $Y_2O_3$:Gd is within the range of 1 to 2 msec, it can be used to provide a longer decay time, which is an object of the invention.

In addition, the method of the present invention produces a double phosphor screen of a blue phosphor and a UV phosphor by performing two coating and drying steps, and one exposure, developing and washing step. Therefore, the method can produce a double phosphor screen without substantially changing the conventional method and increasing production time.

According to the present invention, an aluminum layer is coated after the slurry of a UV phosphor is coated on the blue layer of a conventional red, green and blue phosphor layer.

Additional objects, advantages and novel features of the invention will be set forth in part in the description which follows, and in part will become apparent to those skilled in the art upon examination of the following or may be learned by practice of the invention. The object and advantages of the invention may be realized and attained by means of the instrumentalities and combinations particular pointed out in the appended claims.

Figure 1:
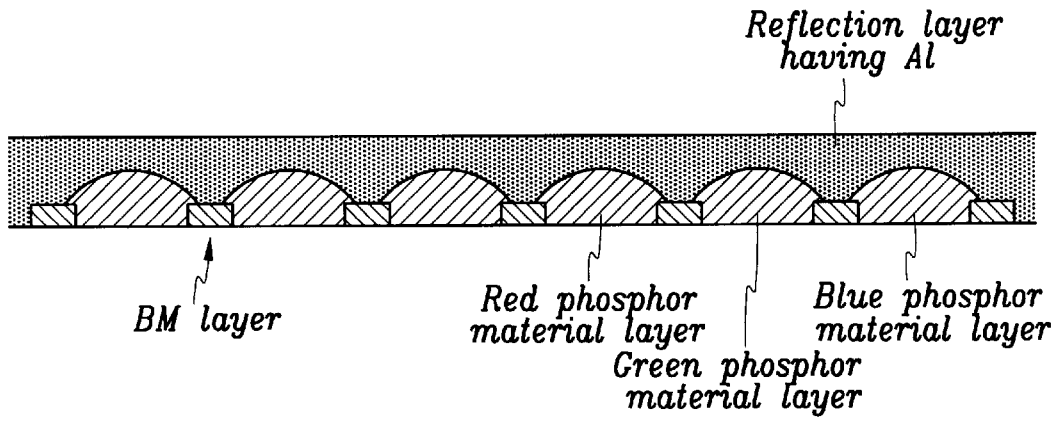
FIG. 1 is a cross-sectional view of a conventional phosphor screen.
Figure 2:
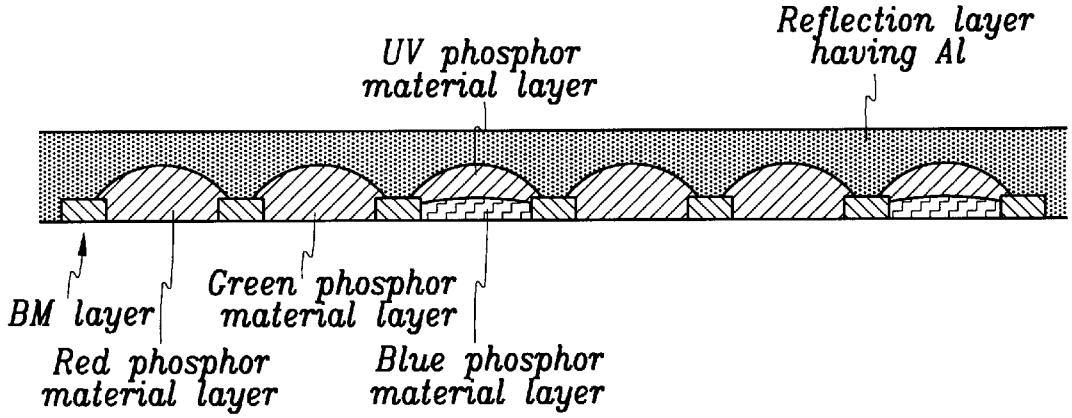
FIG. 2 is a cross-sectional view of a phosphor screen of a double phosphor layer for a flickerless CRT in which a UV phosphor layer is formed on a blue phosphor layer in accordance with an embodiment of the present invention.

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the scope of the invention. Accordingly, the drawing and description are to be regarded as illustrative in nature, and not as restrictive.

DETAILED DESCRIPTION OF THE PREFERRED EMBODIMENTS

Although the invention has been described with reference to a preferred embodiment, it is to be understood that the invention is not limited to the preferred embodiment as herein described.

EXAMPLE

A glass panel is washed, and a photoresist including polyvinyl alcohol, sodium dichromate, a polymer of propylene oxide and ethylene oxide, an acrylic emulsion and pure water is coated on the inside of the panel. The photoresist is dried and developed to prepare a photoresist pattern. Thereafter, graphite is coated on the formed photoresist pattern and etched using hydrogen peroxide to prepare a BM layer by removing the photoresist. Thereafter, a slurry including phosphor particles, pure water and polyvinyl alcohol is coated on the BM layer. The coated slurry is dried, exposed to light, developed, washed and dried to prepare a red and green phosphor screen. A blue phosphor, ZnS:Ag,Cl and a UV phosphor are then formed on the BM layer and simultaneously exposed to light, developed and washed to produce a double phosphor screen including a blue phosphor layer and a UV phosphor layer. The decay time of a phosphor screen formed by the method is much longer than that of a screen formed with only a conventional blue phosphor.

Phosphors containing Pb or Gd are especially useful because their decay times are in the units of milliseconds, and it is known that $BaSi_2O_5$:Pb and $Y_2O_3$:Gd are well luminated by electron beams.

Experimental Examples 1–3

The Determination of the Optimum Amount of Blue Phosphor to be Used in the Coating Material.

When a blue phosphor such as ZnS: Ag, Cl, and a UV phosphor such as $Zn_2SiO_4$:Ti, are coated on the panel as the first and second layer, respectively, the amount of blue phosphor to be coated is an important factor for reducing the flickering phenomenon. Therefore, slurries were prepared with various amounts of blue phosphor as shown in the Table 1 below. After forming a phosphor layer by first coating the slurry of each example on a panel, the decay times and the relative brightness were determined. The results are shown in Table 1. Of the slurries prepared in Experimental Examples 1–3, the slurry of Experimental Example 2 had a long decay time and high relative brightness. Thus, the slurry of Experimental Example 2 was determined to be the optimum amount of blue phosphor to be used in the coating material.

TABLE 1

The determination of the optimum amount of blue phosphor

| | Slurry Condition | | |
|---|---|---|---|
| Ingredients | Experimental Example 1 | Experimental Example 2 | Experimental Example 3 |
| $H_2O$ | 150 g | 150 g | 150 g |
| PVA | 80 g | 83 g | 85 g |
| Surfactant | 16 g | 16 g | 16 g |
| Sensitizer | 5 g | 5 g | 5 g |
| ZnS:Ag,CI | 100 g | 90 g | 80 g |
| Results | | | |
| Decay Time | 150 μs | 150 μs | 150 μs |
| Relative Brightness | 100% | 97% | 90% |

Examples 4–6

The Determination of the Optimum Amount of UV Phosphor to be Used in the Coating Material.

In order to determine the optimum amount of UV phosphor such as $Zn_2SiO_4$:Ti (400 nm), for the second coating, slurries were prepared with various amounts of UV phosphor, which also affects flicker reduction and the brightness of a CRT, as shown in Table 2 below. As the amount of UV phosphor in the slurry increased, the brightness decreased, but the flicker remarkably decreased. The blue phosphor layer was formed on a glass panel 2×2 ($cm^2$)using the slurry of Experimental Example 2, and then the UV phosphor layer was spin-coated thereon. Thereafter, the glass panel was put into a demountable CRT and the luminescence spectrum was analyzed and evaluated using an Osma spectrophotometer (10kV accelerated). The results are shown in Table 2 below.

Comparative Example

The phosphor layer was prepared by the same procedure as in Example 2 except that a UV phosphor such as $Zn_2SiO_4$:Ti was not used. The features of the phosphor screen were evaluated, and the results are shown in Table 2 below.

TABLE 2

The determination of the optimum amount of UV phosphor

| Ingredients | Comparative Example | Example 4 | Example 5 | Example 6 |
|---|---|---|---|---|
| $H_2O$ | — | 150 g | 150 g | 150 g |
| PVA | — | 80 g | 80 g | 80 g |
| Surfactant | — | 16 g | 16 g | 16 g |
| Sensitizer | — | 5 g | 5 g | 5 g |
| Zn2SiO4:Ti UV Phosphor | — | 20 g | 40 g | 60 g |
| Decay Time (10% Decay) | 150 μs | 200 μs | 330 μs | 600 μs |
| Blue Relative Brightness | 100% | 95% | 92% | 87% |
| Color Coordinates (x/y) | 0.153/0.067 | 0.150/0.069 | 0.151/0.070 | 0.152/0.071 |

As shown in Table 2, the blue relative brightness of the phosphor screen of the present invention decreased from 5 to 13% according to the amount of UV phosphor, but the decay time increased up to 4 times the decay time of the Comparative Example. Therefore, it has been proven that the flicker phenomena can be substantially reduced using the method of the invention.

The present invention can increase the decay time of the blue phosphor without changing the circuitry in a CRT by preparing a double phosphor screen comprising a blue phosphor and a UV phosphor. Therefore, a person who watches TV or a monitor comprising the phosphor of the present invention will feel less eye fatigue.

The decay time of the UV phosphor containing Pb, Ti or other activator is much longer than that of a conventional blue phosphor such as ZnS:Ag,CI, and thus the blue phosphor can be excited for a long time. Furthermore, the UV phosphor can be used for development of UV phosphor required for UV phosphor screen which can control decay time of a blue phosphor, and can be applied to cathodoluminescene.

Furthermore, a UV phosphor screen is easily formed only by coating and drying. Therefore, despite the double phosphor layer of the phosphor screen, the present invention does not increase the defect rate in screens produced and can control the decay time, which is a disadvantage of a conventional blue phosphor.

In this disclosure, there has been shown and described only the preferred embodiments of the invention, but, as aforementioned, it is to be understood that the invention is capable of use in various combinations and environments and is capable of changes or modifications within the scope of the inventive concepts as expressed herein.

What is claimed is:

1. A phosphor screen for a flickerless cathode ray tube comprising:

a panel on which a black matrix is formed;

a red phosphor layer formed on selected regions of the panel on which the black matrix is not formed;

a green phosphor layer formed on selected regions of the panel on which the black matrix and red phosphor layer are not formed;

a blue phosphor layer formed on selected regions of the panel on which the black matrix, red phosphor layer, and green phosphor layer are not formed; and an ultraviolet phosphor layer formed on the blue phosphor layer.

2. The phosphor screen for a flickerless cathode ray tube according to claim 1, wherein the wavelengths of ultraviolet light emitted from the ultraviolet phosphor is in the range of 300–420 nm.

3. The phosphor screen for a flickerless cathode ray tube according to claim 1, wherein the ultraviolet phosphor layer is selected from the group consisting of CaS:Pb, CaO:Pb, $Y_2O_3$:Gd, $HfO_2$:Ti, $Zn_2SiO_4$:Ti, $ZnGa_2O_4$:Li,Ti, $Y_2SiO_5$:Ce, $Y_2Si_2O_7$:Ce, $BaSi_2O_5$:Pb and $Ba_2SiO_4$:Pb.

4. The phosphor screen for a flickerless cathode ray tube according to claim 1, wherein the blue phosphor is ZnS:Ag, CI or ZnS:Ag,AI.

5. A method for manufacturing a phosphor screen for a flickerless cathode ray tube comprising the steps of:

forming a black matrix on a panel for a cathode ray tube;

forming a red phosphor layer on selected regions of the panel on which the black matrix is not formed;

forming a green phosphor layer on selected regions of the panel on which the black matrix and red phosphor layer are not formed;

forming a blue phosphor layer on selected regions of the panel on which the black matrix, red phosphor layer, and green phosphor layer are not formed by coating a blue phosphor slurry on the panel and drying the coated slurry; and forming a double phosphor layer by coating an ultraviolet phosphor slurry on the blue phosphor layer and drying the coated ultraviolet phosphor slurry.

6. The method of manufacturing a phosphor screen for a flickerless cathode ray tube according to claim 5, wherein the ultraviolet phosphor is selected from the group consisting of CaS:Pb, CaO:Pb, $Y_2O_3$:Gd, $HfO_2$:Ti, $Zn_2SiO_4$:Ti, $ZnGa_2O_4$:Li,Ti, $Y_2SiO_5$:Ce, $Y_2Si_2O_7$:Ce, $BaSi_2O_5$:Pb and $Ba_2SiO_4$:Pb.

7. The method of manufacturing a phosphor screen for a flickerless cathode ray tube according to claim 5, wherein the blue phosphor is ZnS:Ag,CI or ZnS:Ag,AI.

8. The method of claim 5 wherein the blue phosphor layer is formed from a slurry comprising a blue phosphor present in an amount of at least about 24% by weight based on the total weight of the slurry.

9. The method of claim 5 wherein the blue phosphor layer is formed from a slurry comprising a blue phosphor present in an amount ranging from about 24% by weight to about 29% by weight based on the total weight of the slurry.

10. The method of claim 5 wherein the UV phosphor layer is formed from a slurry comprising a UV phosphor present in an amount ranging from about 7% to about 19% by weight based on the total weight of the slurry.

* * * * *

UNITED STATES PATENT AND TRADEMARK OFFICE

CERTIFICATE OF CORRECTION

PATENT NO. : 5,998,918 
DATED : December 7, 1999
INVENTOR(S) : Young-rag Do, Chang-won Park, Joon-bae Lee and Won-ho Yoon It is certified that error appears in the above-identified patent and that said Letters Patent is hereby corrected as shown below:

Column 4,
Line 32, replace "330 μs" with -- 380 μs --.

Signed and Sealed this

Twentieth Day of August, 2002

*Attest:*

*Attesting Officer*

JAMES E. ROGAN
*Director of the United States Patent and Trademark Office*